US007192322B2

(12) United States Patent
Grzonka et al.

(10) Patent No.: US 7,192,322 B2
(45) Date of Patent: Mar. 20, 2007

(54) LINE DESIGN AND PROPULSION SYSTEM FOR A DIRECTIONALLY STABLE, SEAGOING BOAT WITH RUDDER PROPELLER DRIVE SYSTEM

(75) Inventors: Adam Grzonka, Gdansk (PL); Björn A. Henriksen, Oslo (NO); Jan Kanar, Gdansk (PL); Ryszard Lech, Gdansk (PL); Kay Tigges, Harsefeld (DE)

(73) Assignee: Siemens Aktiengesellschaft, Munich (DE)

( * ) Notice: Subject to any disclaimer, the term of this patent is extended or adjusted under 35 U.S.C. 154(b) by 100 days.

(21) Appl. No.: 10/504,964

(22) PCT Filed: Feb. 17, 2003

(86) PCT No.: PCT/DE03/00479

§ 371 (c)(1),
(2), (4) Date: May 25, 2005

(87) PCT Pub. No.: WO03/070567

PCT Pub. Date: Aug. 28, 2003

(65) Prior Publication Data

US 2005/0215132 A1 Sep. 29, 2005

(30) Foreign Application Priority Data

Feb. 18, 2002 (DE) ..... 102 06 669

(51) Int. Cl.
*B63H 5/16* (2006.01)

(52) U.S. Cl. ..... 440/69

(58) Field of Classification Search ..... 114/288; 440/66, 69

See application file for complete search history.

(56) References Cited

U.S. PATENT DOCUMENTS

| | | | | |
|---|---|---|---|---|
| 3,744,446 | A * | 7/1973 | Gibbins | 440/69 |
| 4,550,673 | A * | 11/1985 | Ingvason | 114/61.28 |
| 4,977,845 | A * | 12/1990 | Rundquist | 114/289 |
| 5,694,877 | A * | 12/1997 | Hvide | 114/61.26 |
| 2004/0063363 | A1 | 4/2004 | Drefs et al. | |

FOREIGN PATENT DOCUMENTS

| | | |
|---|---|---|
| DE | 299 08 430 U1 | 9/1999 |
| DE | 299 13 498 U | 2/2000 |

(Continued)

*Primary Examiner*—Stephen Avila
(74) *Attorney, Agent, or Firm*—Harness, Dickey & Pierce, P.L.C.

(57) ABSTRACT

A seagoing boat is driven by at least two rudder propellers and has a hull for transporting cargo or passengers. The rudder propellers are preferably embodied as electric rudder propellers. The hull has an approximately rectangular cross section amidships, to which flow-directing bodies are connected. A flow channel is configured between the skegs, the flow channel being embodied in a wedge-shaped manner with a continuous, preferably slightly bent enlargement in the direction of the bottom astern. The side walls of the flow channel are configured at least in part as even surfaces and taper off in the form of fin-shaped teeth having water displacement volume. The streaming effect of the flow channel generates a low boat resistance. The influence of the flow channel on the wake has a positive effect on the propulsion efficiency.

25 Claims, 3 Drawing Sheets

FOREIGN PATENT DOCUMENTS

| | | | |
|---|---|---|---|
| DE | 299 13 498 | U1 | 2/2000 |
| DE | 200 03 451 | U1 | 12/2000 |
| DE | 101 41 893 | A1 | 8/2002 |
| DE | 101 59 427 | A1 | 6/2003 |
| FR | 1 425 538 | A | 1/1966 |
| FR | 1 425 538 | | 1/1996 |
| WO | WO 00/68072 | A1 | 11/2000 |
| WO | WO 03/047965 | A1 | 6/2003 |

* cited by examiner

LINE DESIGN AND PROPULSION SYSTEM FOR A DIRECTIONALLY STABLE, SEAGOING BOAT WITH RUDDER PROPELLER DRIVE SYSTEM

This application is the national phase under 35 U.S.C. § 371 of PCT International Application No. PCT/DE03/00479 which has an International filing date of Feb. 17, 2003, which designated the United States of America and which claims priority on German Patent Application number DE 102 06 669.8 filed Feb. 18, 2002, the entire contents of which are hereby incorporated herein by reference.

FIELD OF THE INVENTION

The invention generally relates to a sea-going vessel. More preferably, it relates to one which is propelled by at least two steering propellers and has a hull for transporting cargoes or passengers. The steering propellers are preferably in the form of electrical steering propellers (PODS). Further, the hull preferably has an approximately rectangular cross section midships, adjacent to which, toward the stern, there are flow guide bodies (skegs), between which a flow channel is formed.

BACKGROUND OF THE INVENTION

German Utility Model 29913498.9 discloses a high-speed sea-going vessel which has hydrodynamically acting skegs in front of the electrical steering propellers.

SUMMARY OF THE INVENTION

An object of an embodiment of the invention is to further optimize a vessel such as this. In particular, the sea-going behavior of the vessel is intended to be improved and, furthermore, a particularly advantageous incident flow to the electrical steering propellers is intended to be achieved.

In one embodiment, the already known vessel has been designed especially for use of electrical steering propellers in each case having one traction propeller and one pusher propeller on the steering propeller. Thus, a further object of an embodiment of the invention is to refine a vessel such as this such that it can be propelled by steering propellers which each have only one propeller, and can also be operated with improved propulsion efficiency.

An object of an embodiment may be achieved in that the flow channel is wedge-shaped and widens continuously, preferably with slight curvature, toward the area under the stern, with the side walls of the flow channel being at least partially in the form of planar surfaces and running into fin-like webs which have displacement volumes for the water, and with the flow channel being designed such that its channel effect results in low vessel drag.

The creation of the optimized flow channel according to an embodiment of the invention between the skegs advantageously results in low wake drag and a low incident flow speed to the electrical steering propellers. This reduces the drag of the vessel during motion through the water, and the propulsion efficiency can be increased.

One refinement of an embodiment of the invention provides for the skegs to be in the form of fin-like webs, with the displacement volumes of the skegs running into stubs which, toward the stern, run to a point shortly in front of the steering propellers, without any vertical connection to the hull. This embodiment advantageously means that the pressure difference between the inside and the outside of the flow channel upstream of the steering propellers results in a flow around the ends of the skegs, which runs in the same direction as the flow that is induced by the propellers. This advantageously improves the incident flow response of the propellers, and makes the incident flow to the propellers uniform.

A further refinement of an embodiment of the invention provides that the displacement volumes of the skegs are arranged essentially on the outside of the fin-like webs. This advantageously results in a low-drag flow channel between the skegs with a smooth water wake at the stern of the vessel and, in consequence, with the stern of the vessel having a particularly advantageous drag response.

A further refinement of an embodiment of the invention provides for the displacement volumes on the outside to be in the form of beads. The bead is shaped such that the water flows around and away asymmetrically in the same rotation direction as the respective steering propeller, in order that the flow that is influenced in this way has an advantageous effect on the flow to the propeller. The advantageous effect of the smooth water outlet flow from the flow channel is thus supplemented by the water being provided with a rotational movement even before the propellers thus resulting in an incident flow which, overall, is advantageous for the propellers.

An embodiment of the invention furthermore provides that the shape and volume of the flow channel at its outlet in the area of the stub are sufficiently large and the displacement volumes are arranged and are dimensioned such that the water flowing around and away is directed in such a way that it flows around the stubs in the same rotation direction as the respective steering propeller. In conjunction with the asymmetric configuration of the displacement volumes of the skegs, this therefore results in an advantageous, uniform incident flow, in particular with little swirl, to the propellers, in a manner which is advantageous for the avoidance of cavitation. In the process, there is no need to dispense with the normal rise of the stern with its advantageous effect on the course stability response and on the so-called "slamming response" of the vessel.

Provision is also made for the steering propellers to have at least one propeller which is in the form of a high-skew propeller and which is matched to the manipulated incident flow of the water according to one embodiment of the invention. This results in a further improvement of the low-vibration behavior of the propellers, with the tendency to cavitate being minimized. In the case of a steering propeller with two propellers which rotate in the same direction, a conventional propeller may also be used for the pusher propeller.

Provision is also made, in one embodiment, for the individual dimensions of the vessel's hull and of the skegs and their composite dimensions to be matched to the speed of the vessel, in particular as a result of tank towing trials. The same applies to the dimensions of the high-skew propeller. The individual flow parameters which this results in at the stern, are dependent, for example, on the size of the vessel, the speed of the vessel, the roughness of the hull surface and further characteristics which vary from one vessel to another. It is thus self-evident that different individual dimensions must be chosen for the vessel's hull, for the skegs, for the flow channel and for the propellers for each vessel type. These vary within ranges which must in each case be investigated and optimized in towing trials and tanks tests. The cargo hold capacity and the costs for manufacturing the vessel are also relevant in this case, thus resulting in a large number of variation options, of which only limit dimensions can be stated. These are advantageously quoted as percentages of the width and length of the vessel, and of its draught etc.

A further refinement of an embodiment of the invention furthermore provides for further individual dimensions of the stern, for example the rise and the projection beyond the steering propellers toward the stern, as well as the dimensions of the skegs, for example the outward positioning, the length and the shape, to be optimized such that the influence of waves in particular of waves striking the vessel from astern, on the hull (sea impact) is reduced, preferably as a result of tank trials. For a sea-going vessel, it is not only important for the vessel's drag to be low, but also for the vessel to have a good sea-going behavior. The sea-going behavior of the vessel is particularly important in a sea which is striking it from astern, and possibly also when lying in rough harbours, so that it is also necessary to take account of the shape of the stern of the vessel on its sea-going behavior. This is the case according to the invention. In this case, the shape of the forward part of the vessel is also taken into account, since this has a significant effect when the vessel is moving straight ahead.

In order to optimize the propulsion system, provision is also made for the steering propellers to be equipped with pusher propellers; this means that a relatively long contact section is provided for the water before it enters the propeller cross section. The wake vortices which are formed on the hull can thus at least partially be compensated for. The cavitation response of the propellers is thus considerably improved without there being any need for high-skew propellers. In this case, it may be necessary to accept a certain loss of efficiency in comparison to a traction propeller whose wake flow is directed by the steering propeller housing, and possibly by fins arranged here and by the shaft of the steering propeller. This is a question of costs and flow optimization, and is possibly the subject matter of tank trials.

The two steering propellers are advantageously arranged at such a distance from one another that the steering propellers can first of all be pivoted independently of one another through 360 degrees but that, secondly, the distance between the skegs is not too great. In fact, the skegs are arranged in an aligned manner upstream of the steering propellers. One optimum arrangement is for the distance between the two steering propellers to be 1.1 to 1.3 times the propeller diameter.

The arrangement of a small separate rudder for travelling straight ahead, various variants of which are disclosed in Pattern Application DE 101 59 427.5, which was not published prior to this, has an advantageous effect on the energy consumed when travelling straight ahead. The steering propellers can thus always be set in the optimum incident flow direction and do not need to be swivelled continuously for course stabilization. This also results in an energy saving by avoiding thrust deflection, which is greater than the drag of the separate rudder. The optimum incident flow direction for each steering propeller differs depending on the tolerances of the vessel's hull, of the skegs and of the steering propeller installation, and, if necessary, is advantageously determined during test runs of the complete vessel.

BRIEF DESCRIPTION OF THE DRAWINGS

Further advantages, features and details of the invention will become evident from the description of illustrated exemplary embodiments given hereinbelow and the accompanying drawings, which are given by way of illustration only and thus are not limitative of the present invention, wherein.

DETAILED DESCRIPTION OF THE PREFERRED EMBODIMENTS

Figure 1:
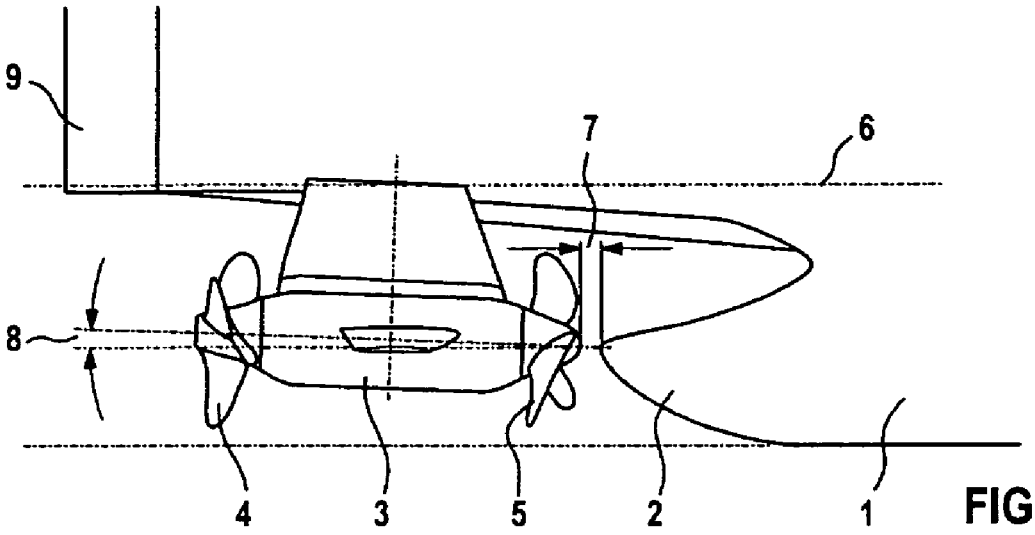
FIG. 1 shows an example of a skeg/steering propeller arrangement.

FIG. 1 shows a side view of the area of the stern, in the normal manner for vessel construction, in which the electrical steering propellers and the skegs are located. 1 denotes a skeg, which is seen from the side and ends in the round bead 2. 3 denotes an electrical steering propeller; by way of example, the figure shows an electrical steering propeller with two propellers 4 and 5 and side fins. It is self-evident that a steering propeller with a traction propeller or a steering propeller with a pusher propeller, in each case with the flow guide elements appropriate for this purpose, can likewise be used.

6 denotes the construction water line (CWL) and 7 the distance between the end of the skeg bead and the traction propeller of the electrical steering propeller. This distance is the subject matter of an optimization process since, on the one hand, the propeller 5 must be able to swivel downstream from the outlet from the bead 2 while, on the other hand, the distance to the bead 2 should be as short as possible.

In order to avoid vibration and in order to reduce cavitation, a flow comparison section may be advantageous for some vessels. The flow smoothing section is at its longest when using a POD with a pusher propeller corresponding to propeller 4. In this case, the housing of the electrical steering propeller 3 and the shaft of the electrical steering propeller also acts as a flow smoothing element.

The electrical steering propeller is advantageously inclined at an angle, for example of 2 degrees, to the horizontal direction. This angle is annotated 8. The end of the vessel is annotated 9; like the other components at the stern of the vessel, its length is also dependent on the configuration of the stern, and hence also on the type of vessel.

Figure 2:
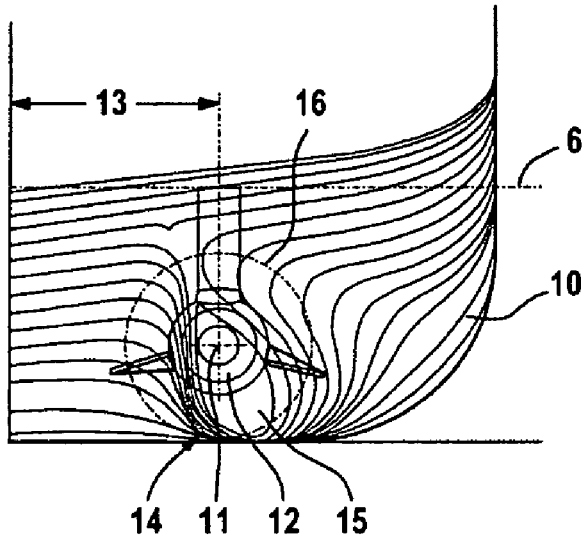
FIG. 2 shows a bulkhead profile scheme, seen from the stern, showing a POD corresponding to FIG. 1.

In FIG. 2, which shows the vessel lines (bulkhead profiles) from astern, 10 denotes a typical bulkhead profile and 12 denotes the electrical steering propeller as can be seen from astern. As can be seen, although, as can be seen from FIG. 1, the center 11 of the steering propeller is located astern of the end of the starboard, it is arranged asymmetrically with respect to the displacement volume 15. The steering propeller itself is arranged at the distance 13 from the center line of the vessel; the length 13 is approximately 1.1 times the propeller diameter 16. The essentially planar configuration of the inside of the flow channel according to the invention, which is shown between the skegs 1 from FIG. 1, is governed to a considerable extent by the line profile in the area 14.

Figure 3:
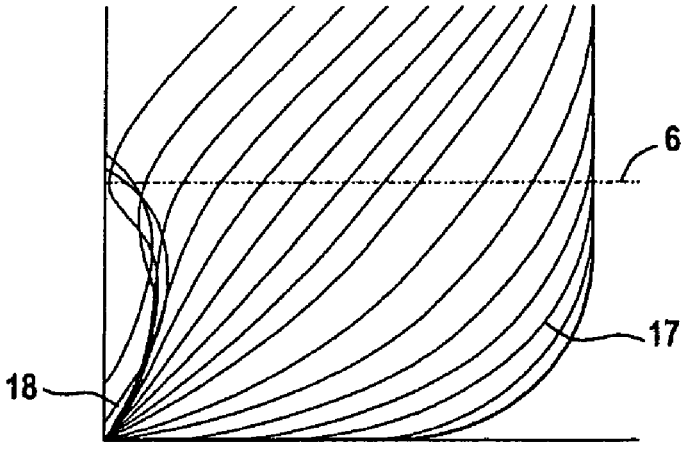
FIG. 3 shows a bulkhead profile scheme from ahead.

In FIG. 3, which shows the vessel's line profile (bulkhead profile) seen from ahead, 17 denotes a normal bulkhead profile and 18 the profile at the bulb, which is arranged at the bow of the vessel.

FIG. 3 essentially shows a conventional vessel's line profile, as is normal for stable-course and low-drag sea-going vessels.

Figure 4:
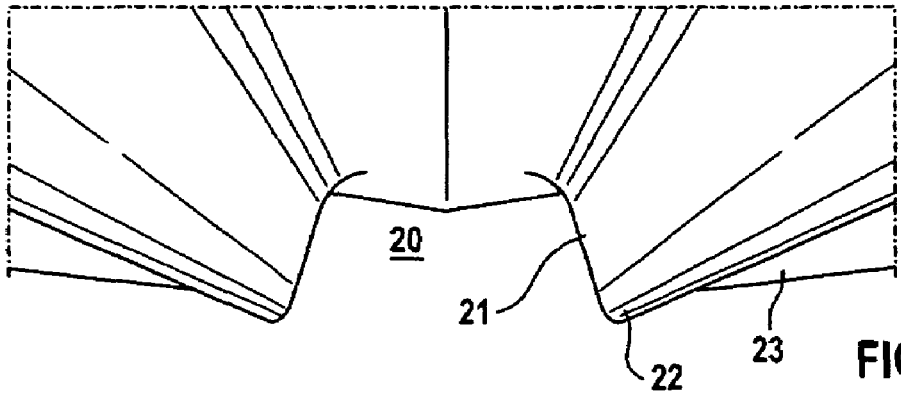
FIG. 4 shows an illustration of a flow channel according to an embodiment of the invention on a towing tank model.
Figure 5:
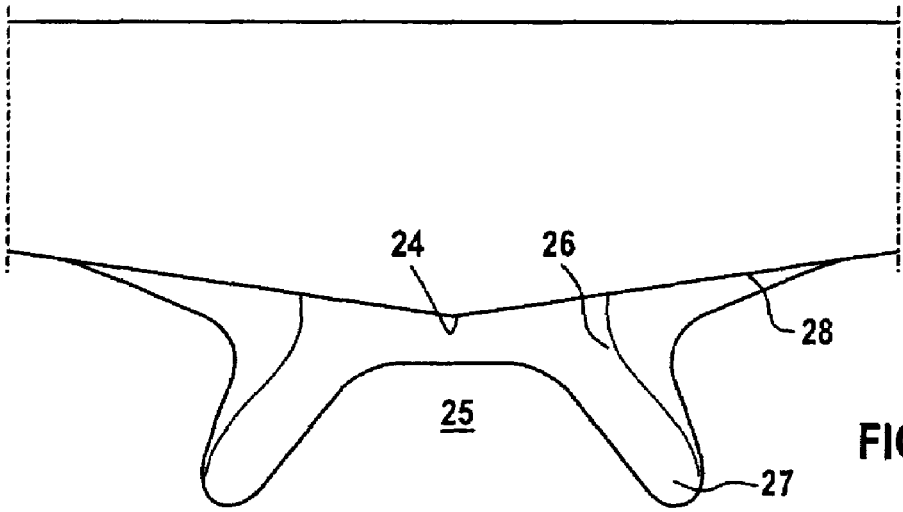
FIG. 5 shows the model with the flow channel as shown in FIG. 4, from astern.
Figure 6:
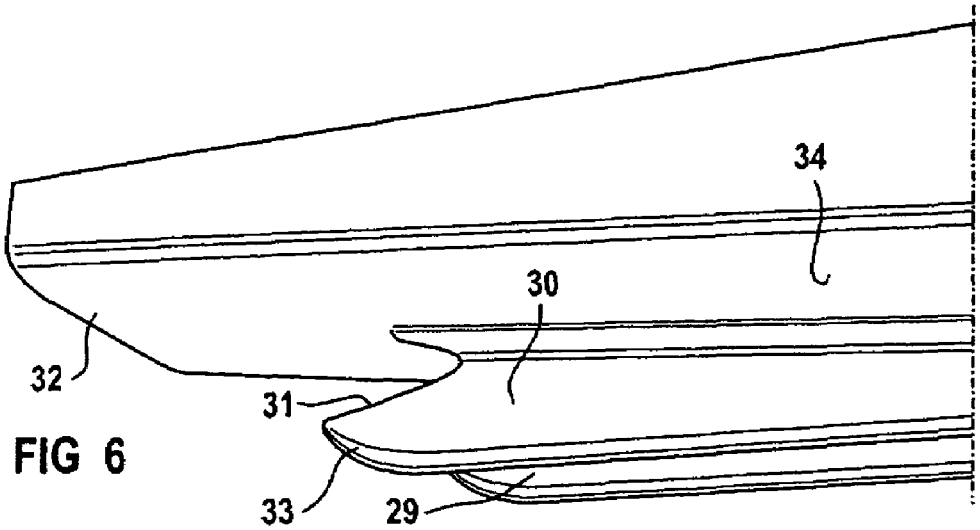
FIG. 6 shows the skegs from the side, with the flow channel corresponding to FIGS. 4 and 5.

FIGS. 4, 5 and 6 show illustrations of an optimized towing model, and illustrate the lower part of the end of the hull of the towing model of a relatively high-speed ferry (28 knots) with a hull which is intended for holding motor vehicles and passengers. Towing models such as these are normally used for determining the optimum hull shapes for vessels, and are generally known to those skilled in the art.

In FIG. 4, 20 denotes the flow channel which is formed between the skegs 22 with their virtually planar, continuously running side walls 21. The lower surface 23 of the vessel is likewise continuous, and is curved only slightly like the inside 21 of the flow channel 20.

In FIG. 5, 25 denotes the flow channel seen from astern between the skegs 26, which is arranged under the apex point 24 of the rise 28 of the stern of the vessel. Toward the stern, the skegs 26 are in the form of sharp fins and have bead-like ends 27 which project beyond the fin-like parts of the skegs 26 without any supporting elements. Overall, this results in a stern shape which is highly advantageous in terms of flow, and with good characteristics with regard to seas striking from astern.

In FIG. 6, the flow channel between the skegs 30 is annotated 29. The fin-like end of the skegs is annotated 31, and the bead-like displacement volume is annotated 33. For optimization purposes, an inter-changeable, variable stern section 32 is arranged downstream of the skegs 30, and is used to determine the optimum length and, possibly, inclination of the vessel's stern. The bottom of the vessel has a shape which can clearly be seen in the illustration, runs obliquely upward and covers about ⅓ of the vessel. This results in a smooth, relatively slow wake flow at the stern of the vessel, which leads to low vessel drag.

Figure 7:
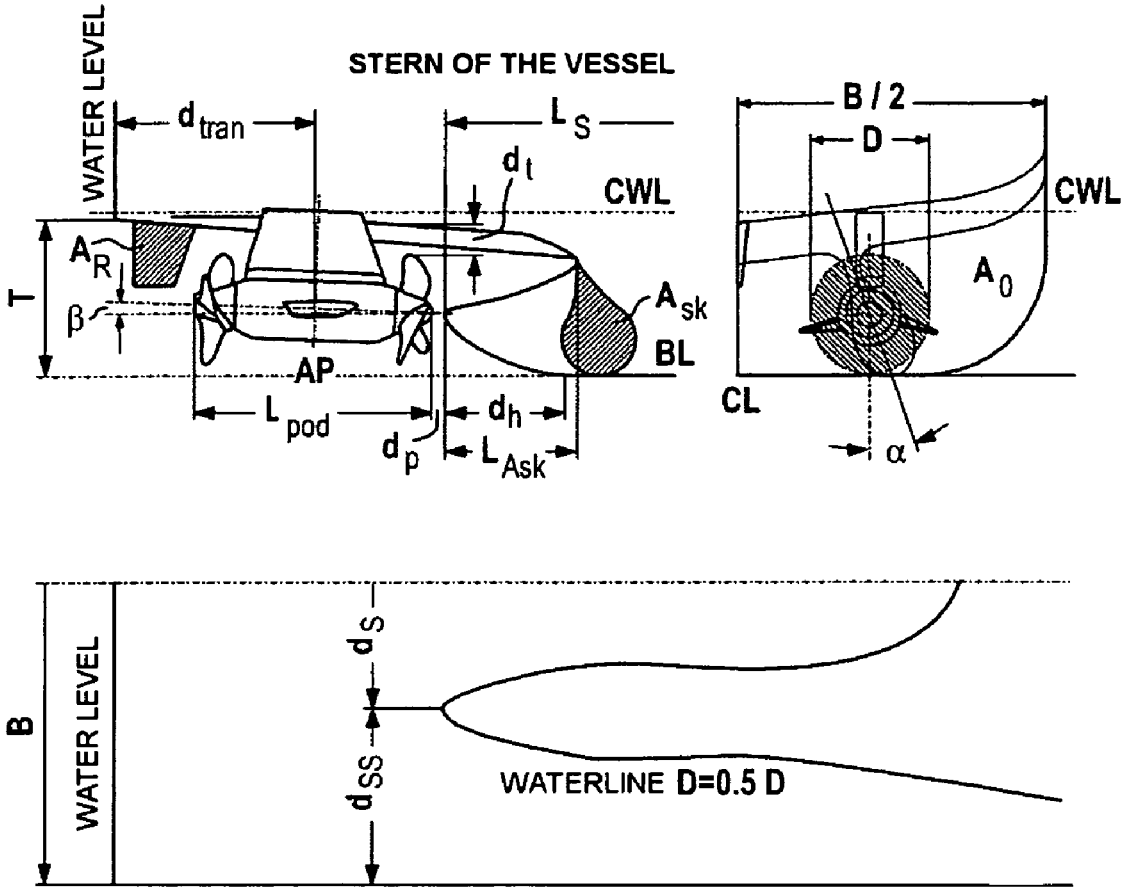
FIG. 7 shows the principle of the arrangements.

FIG. 7 shows the basic arrangement of the individual components, for illustrative purposes. These are the normal illustration forms that are used in international vessel construction. The parameter values and their claimed applicability areas are mathematically defined as follows:

$A_{sk}$ Is the cross-sectional area of the skeg with the length $L_{Ask;}$, spaced from the rear end of the skeg.

$A_0$ $0.1*A_0<A_{sk}<A_0$ is the area of the propeller circle $A_R$ $A_0=\pi*D^2/4=0.7853*D^2$ is the projected area of the auxiliary rudder $L_S$ $0.01*A_0<A_R<0.01*L_{PP}*T$ is the length of the skeg $L_{Ask}$ $0.20*L_{PP}<Ls<0.45*L_{PP}$ is the distance from the tip of the skeg to the defined cross section $L_{pod}$ $A_{sk}$ is the length of the POD.

$d_{tran}$ is the distance from the rear vertical datum to the hull at the waterline $d_s$ $2*L_{pod}>d_{tran}>L_{pod}/2$ is the distance between the center lines of the skegs at their tip and the rear end of the skegs $d_{ss}$ $1.5*D<d_s<B-1.5*D$ is the minimum distance between the center line at the end of the skeg and the side of the vessel at the start of the rise of the bilge radius.

$d_h$ $d_{ss}>0.75*D$ is the distance between the rear end of the skeg and the point at which the baseline of the skeg starts to rise from the baseline of the vessel.

$d_p$ $d_h>0.3*L_{Ask}$ is the distance between the propeller hub and the rear end of the skeg $d_t$ $0.02*D<d_p<0.02*L_{pp}$ is the propeller clearance at the front propeller plane α $d_t>0.15*D$ is the angle between the skeg and the normal to the base of the vessel β $\alpha<30°$ is the angle between the center line of the POD propellers and the base of the vessel in the longitudinal section D $\beta<5°$ is the propeller diameter Lpp is the length between the verticals B is the width of the vessel at the bulkhead T is the draught of the vessel at the bulkhead AP is the rear vertical datum The steering propellers, the skegs and the stern shape are elements which interact with one another with regard to the design according to an embodiment of the invention. This leads to the vessel's drag being very low overall, and with the electrical steering propellers having a high propulsion efficiency. The electrical steering propellers are in this case arranged in the outlet flow from the skegs, such that the rotation axes of the propellers match within the region with a considerably reduced axial component of the velocity field. Since the electrical steering propellers are arranged downstream from the skegs, this allows the propellers to be operated in the downstream flow field of the skegs.

The shaped flow channel advantageously supplies the downstream water in a directed manner to the propellers. The lateral position of the skegs and the shape of the flow guide bodies influence the velocity field within the propeller disks such that the tangential components of the velocity field run into the propeller in an advantageously favorable manner. This results in an improvement in the efficiency of the propulsion system, with reduced cavitation and reduced oscillations and vibrations. Furthermore, the skegs result in the vessel having better course stability. In the final analysis, this results in a considerable saving of fuel.

The use of an auxiliary rudder may also contribute to this, allowing the electrical steering propellers always to be optimally set with respect to the downstream flow in the skeg area. This optimum setting does not need to be changed by movements for course correction.

Exemplary embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. A sea-going vessel, comprising:

at least two steering propellers, adapted to propel the vessel;

a hull for transporting at least one of cargoes and passengers; and flow guide bodies, adjacent to the hull, between which a flow channel is formed, wherein the flow channel is wedge-shaped and widens continuously toward an area under the stern of the vessel, wherein side walls of the flow channel are at least partially in the form of planar surfaces and running into fin-like webs which have displacement volumes for the water, and wherein the channel effect of the flow channel produce low vessel drag, and has an influence on the wake which is advantageous for the propulsion response.

2. The vessel as claimed in claim 1, wherein the flow guide bodies are in the form of fin-like webs, with the displacement volumes of the flow guide bodies running into stubs which, toward the stern, run to a point shortly in front of the steering propellers, without any vertical connection to the hull.

3. The vessel as claimed in claim 1 wherein the displacement volumes of the flow guide bodies are arranged essentially on the outside of the fin-like webs.

4. The vessel as claimed in claim 1, wherein the displacement volumes are in the form of beads on the outside, with the bead being shaped such that the water flows around and away asymmetrically in the same rotation direction as the respective steering propeller, in order that the flow that is influenced in this way has an advantageous effect on the flow to the propeller.

5. The vessel as claimed in claim 1, wherein the bottom of the vessel has a rise which starts approximately at the start of the flow guide channel.

6. The vessel as claimed in claim 1, wherein the shape and volume of the flow channel at its outlet in the area of the stub are sufficiently large and the displacement volumes are arranged and are dimensioned such that the water flowing around and away is directed in such a manner that it flows around the stubs in the same rotation direction as the respective steering propeller.

7. The vessel as claimed in claim 1, wherein the steering propellers have at least one propeller which is in the form of a high-skew propeller.

8. The vessel as claimed in claim 7, wherein the high-skew propeller is matched to the characteristics of the directed incident water flow such that large pressure fluctuations are avoided and the cavitation response is optimized.

9. The vessel as claimed in claim 1, wherein the individual dimensions of the vessel's hull and of the flow guide bodies and their composite dimensions are matched to the speed of the vessel.

10. The vessel as claimed in claim 1, wherein the dimensions of the high-skew propeller are optimized for the directed incident flow.

11. The vessel as claimed in claim 1, wherein the individual dimensions of the stern are optimized such that the influence of waves on the hull is reduced.

12. The vessel as claimed in claim 1, wherein the electrical steering propellers each have one propeller which is in the form of a pusher propeller.

13. The vessel as claimed in claim 1, wherein the distance between the steering propellers corresponds to 1.1 to 1.3 times the respective propeller diameter.

14. The vessel as claimed in claim 1, wherein an auxiliary rudder for guiding the vessel straight ahead is arranged at the stern of the vessel.

15. The vessel as claimed in claim 1, wherein the steering propellers are in the form of electrical steering propellers, and wherein the hull has an approximately rectangular cross section midships.

16. The vessel as claimed in claim 1, wherein the flow channel is wedge-shaped and widens continuously, with slight curvature.

17. The vessel as claimed in claim 2, wherein the displacement volumes of the flow guide bodies are arranged essentially on the outside of the fin-like webs.

18. The vessel as claimed in claim 2, wherein the displacement volumes are in the form of beads on the outside, with the bead being shaped such that the water flows around and away asymmetrically in the same rotation direction as the respective steering propeller, in order that the flow that is influenced in this way has an advantageous effect on the flow to the propeller.

19. The vessel as claimed in claim 2, wherein the bottom of the vessel has a rise which starts approximately at the start of the flow guide channel.

20. The vessel as claimed in claim 1, wherein the individual dimensions of the vessel's hull and of the flow guide bodies and their composite dimensions are matched to the speed of the vessel, as a result of tank towing trials.

21. The vessel as claimed in claim 1, wherein the dimensions of the high-skew propeller are optimized for the directed incident flow as a result of tank trials.

22. The vessel as claimed in claim 20, wherein the dimensions of the high-skew propeller are optimized for the directed incident flow as a result of the tank towing trials.

23. The vessel as claimed in claim 1, wherein the individual dimensions of the rise of the stern and the projection beyond the steering propellers toward the stern and the dimensions of the outward positioning, the volume and the shape of the flow guide bodies, are optimized such that the influence of waves on the hull is reduced.

24. The vessel as claimed in claim 22, wherein the individual dimensions of the rise of the stern and the projection beyond the steering propellers toward the stern and the dimensions of the outward positioning, the volume and the shape of the flow guide bodies, are optimized such that the influence of waves on the hull is reduced as result of the tank towing trials.

25. The vessel as claimed in claim 1, wherein an auxiliary rudder for guiding the vessel straight ahead is arranged at the stern of the vessel, in front of the propellers of the steering propellers, and wherein the auxiliary rudder is in the form of a blade rudder.

* * * * *